US006523270B1

(12) United States Patent
Cheung

(10) Patent No.: US 6,523,270 B1
(45) Date of Patent: Feb. 25, 2003

(54) UNIVERSAL HELIODON-SUNDIAL

(75) Inventor: Kwok Pun Cheung, Hong Kong (HK)

(73) Assignee: University of Hong Kong, Hong Kong (HK)

( * ) Notice: Subject to any disclaimer, the term of this patent is extended or adjusted under 35 U.S.C. 154(b) by 0 days.

(21) Appl. No.: 09/924,286

(22) Filed: Aug. 8, 2001

(51) Int. Cl.[7] ..... G04B 49/02

(52) U.S. Cl. ..... 33/270; 33/1 DD

(58) Field of Search ..... 33/270, 1 E, 1 K, 33/1 CC, 1 DD, 1 G, 268, 269, 271

(56) References Cited

U.S. PATENT DOCUMENTS

| | | | | | |
|---|---|---|---|---|---|
| 2,328,456 | A | | 8/1943 | Humphreys | |
| 3,068,574 | A | | 12/1962 | Bieg | |
| 3,090,124 | A | * | 5/1963 | Fruhling | 33/1 DD |
| 3,568,320 | A | * | 3/1971 | Potter | 33/1 DD |
| 4,103,429 | A | * | 8/1978 | Wagoner | 33/270 |
| 4,237,611 | A | | 12/1980 | Wurch et al. | |
| D267,837 | S | | 2/1983 | Migani et al. | |
| D271,824 | S | | 12/1983 | Massaro | |
| 4,457,296 | A | * | 7/1984 | Klann | 33/1 DD |
| 4,470,820 | A | | 9/1984 | Mori | |
| 4,645,354 | A | * | 2/1987 | Mercer | 33/270 |
| 4,881,899 | A | | 11/1989 | Derome | 434/72 |
| 4,890,269 | A | * | 12/1989 | Buckner et al. | 33/270 |

OTHER PUBLICATIONS

Cheung, K. P et al., "A Light Duty Universal Direct Sunlight Heliodon", Architectural Science Review, vol. 39, Dec. 1996, pp. 187–191.

Cheung, K P et al., "A 23–Lamp Heliodon", Architectural Science Review, vol. 42, Mar. 1999, pp. 49–54.

Dufton, A.F. et al., Orientation of Buildings, Notes by the Science Standing Committee, "Sun Planning by Means of Models", Journal of the Royal Institute Of British Architects, May 16, 1931, pp. 509–510.

Olgyay and Olgyay, "Solar Control & Shading Devices", Princeton University Press, 1957, pp. 26–27; 42–43.

Robbins, C L, "Daylighting Design & Analysis", Van Nostrand Reinhold, New York, 1986, pp. 227–228 and photos C–4, C–6, C–7, C–8.

Strahler, A N, "Physical Geography", John Wiley and Sons, New York, 6th edition, 1975, pp. 83–85.

* cited by examiner

*Primary Examiner*—Christopher W. Fulton
(74) *Attorney, Agent, or Firm*—Jones, Day, Reavis & Pogue

(57) ABSTRACT

An apparatus for use with a source of light including a first orientation device that includes a latitude scale, a latitude pointer rotatable about a first axis relative to the latitude scale, and a platform configured to support an architectural model. The platform is mounted on the latitude pointer such that rotation of the pointer about the first axis produces a corresponding change in the position of the platform relative to the latitude scale. The apparatus also includes a second orientation device that includes a time scale and a time pointer rotatable about a second axis relative to the time scale. The first orientation device is mounted on the time pointer such that rotation of the time pointer about the second axis produces a corresponding change in the position of the platform relative to the time scale without changing the position of the platform relative to the latitude scale. The apparatus further includes a third orientation device that includes a day of the year scale, a gnomon operatively oriented relative to the day of the year scale, and a universal joint supporting the third orientation device for movement relative to a source of light. The second orientation device is mounted on the third orientation device such that movement of the third orientation device on the universal joint produces a corresponding change in the position of the platform relative to the source of light without changing the position of the time pointer relative to the time scale or the position of the platform relative to the latitude scale.

12 Claims, 7 Drawing Sheets

UNIVERSAL HELIODON-SUNDIAL

FIELD OF THE INVENTION

The present invention relates to an apparatus configured to simulate the directional and parallelity aspects of sunlight falling on a three dimensional model for any specified combination of latitude, time of day, and day of the year.

BACKGROUND OF THE INVENTION

Heliodons were originally configured to be operated indoors using an artificial light source to simulate the effect of sunlight falling on a model. Subsequent heliodon designs were developed that used the sun as the source of light. Heliodons of the second type enable the model to be positioned relative to the sun for a specified day, time, and latitude. The heliodon is operated by adjusting and holding the apparatus to the desired day and time as indicated on a shade dial. The shade dial is set to the desired latitude and mounted on the model. A similar method includes mounting a sundial onto the model and subsequently mounting the model onto a tripod. The mounted sundial is set to the desired latitude. The desired simulated day(s) and time(s) for casting sunlight onto the building model are obtained by manipulating and fixing the components of the tripod, such that sunlight falling onto the sundial indicates the desired day and time.

SUMMARY OF THE INVENTION

The invention provides an apparatus for use with a source of light, the apparatus comprising a first orientation device including a latitude scale, a latitude pointer rotatable about a first axis relative to the latitude scale, and a platform configured to support an architectural model. The platform is mounted on the latitude pointer such that rotation of the pointer about the first axis produces a corresponding change in the position of the platform relative to the latitude scale.

The apparatus also includes a second orientation device that includes a time scale and a time pointer rotatable about a second axis relative to the time scale. The first orientation device is mounted on the time pointer such that rotation of the time pointer about the second axis produces a corresponding change in the position of the platform relative to the time scale without changing the position of the platform relative to the latitude scale.

The apparatus further includes a third orientation device that includes a day of the year scale, a gnomon operatively oriented relative to the day of the year scale, and a universal joint supporting the third orientation device for movement relative to a source of light.

The second orientation device is mounted on the third orientation device such that movement of the third orientation device on the universal joint produces a corresponding change in the position of the platform relative to the source of light without changing the position of the time pointer relative to the time scale or the position of the platform relative to the latitude scale.

DESCRIPTION OF A PREFERRED EMBODIMENT

Figure 1:
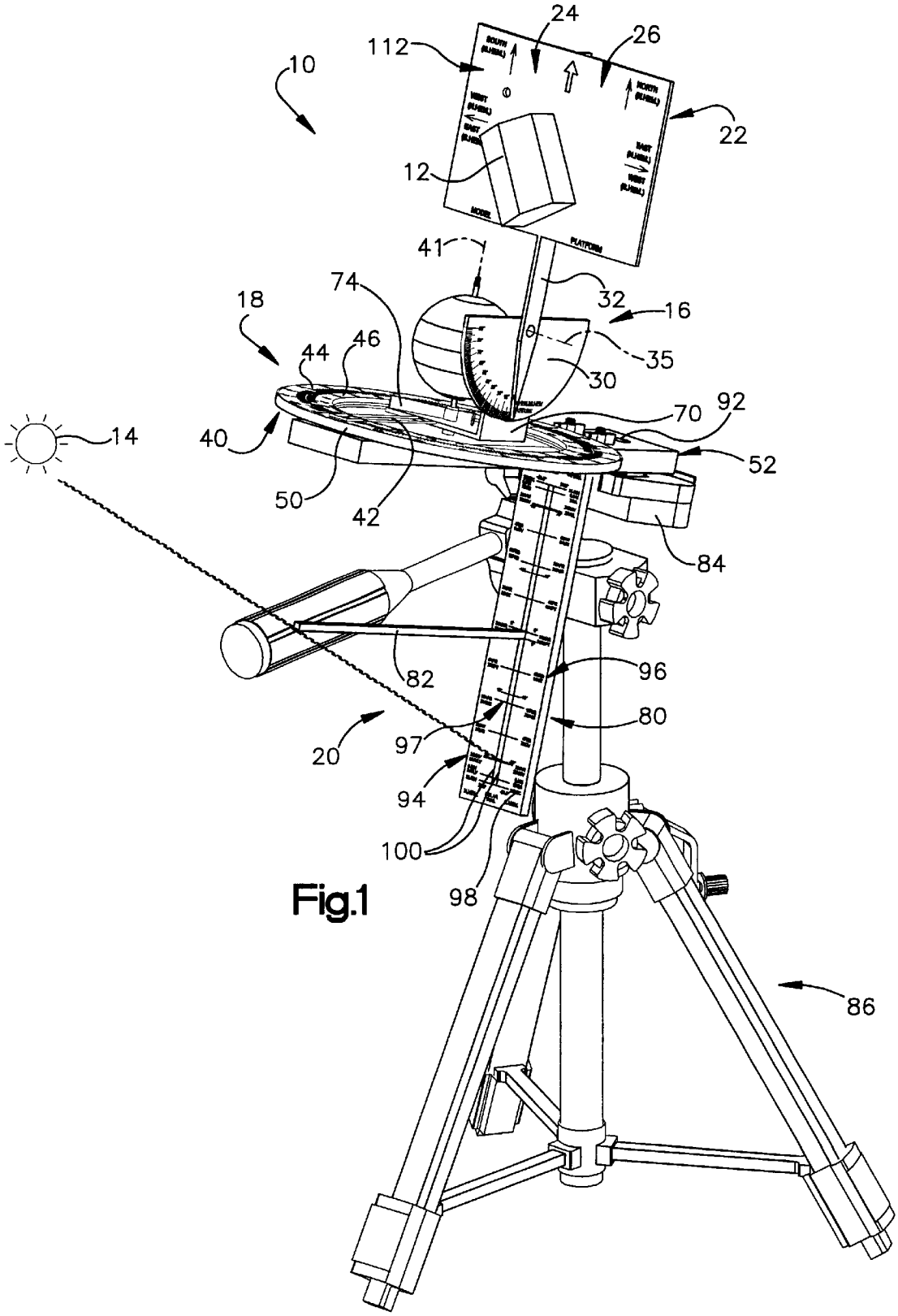
FIG. 1 is an axonometric view of a preferred embodiment of the present invention.

An apparatus 10 comprising a preferred embodiment of the present invention is shown in FIG. 1. The apparatus 10 is a universal heliodon configured to support a model 12 in a position relative to a source 14 of light, which in the first embodiment is the sun 14. The apparatus 10 includes three orientation devices 16, 18 and 20 which are movable relative to each other. The orientation devices 16, 18 and 20 work together to move the model 12 into a position relative to the sun 14 for a specified geographical hemisphere, latitude, time of day, and day of the year. Specifically, the first orientation device 16 moves the model 12 into a position relative to the sun 14 for a specified latitude and hemisphere. The second orientation device 18 moves the model 12 into a position relative to the sun 14 corresponding to a specific time of day. The third orientation device 20 places the model 12 in a position relative to the sun for a specific day of the year.

As shown in FIG. 1, the first orientation device 16 includes a platform 22 which is used to support the model 12. True North-South reference points on the left side 24 of the platform 22 indicate where the model 12 is to be placed for viewing in the Southern Hemisphere. Additional True North-South reference points on the right side 26 of the platform 22 indicate where the model 12 is to be placed for viewing in the Northern Hemisphere. Accordingly, the heliodon 10 is universal, i.e., it can be used to position the model 12 relative to either the Northern or Southern Hemisphere. The model 12 is positioned with reference to a given hemisphere and is then secured to the platform 22 through the use of an adhesive or any other suitable fastening structure.

Figure 2:
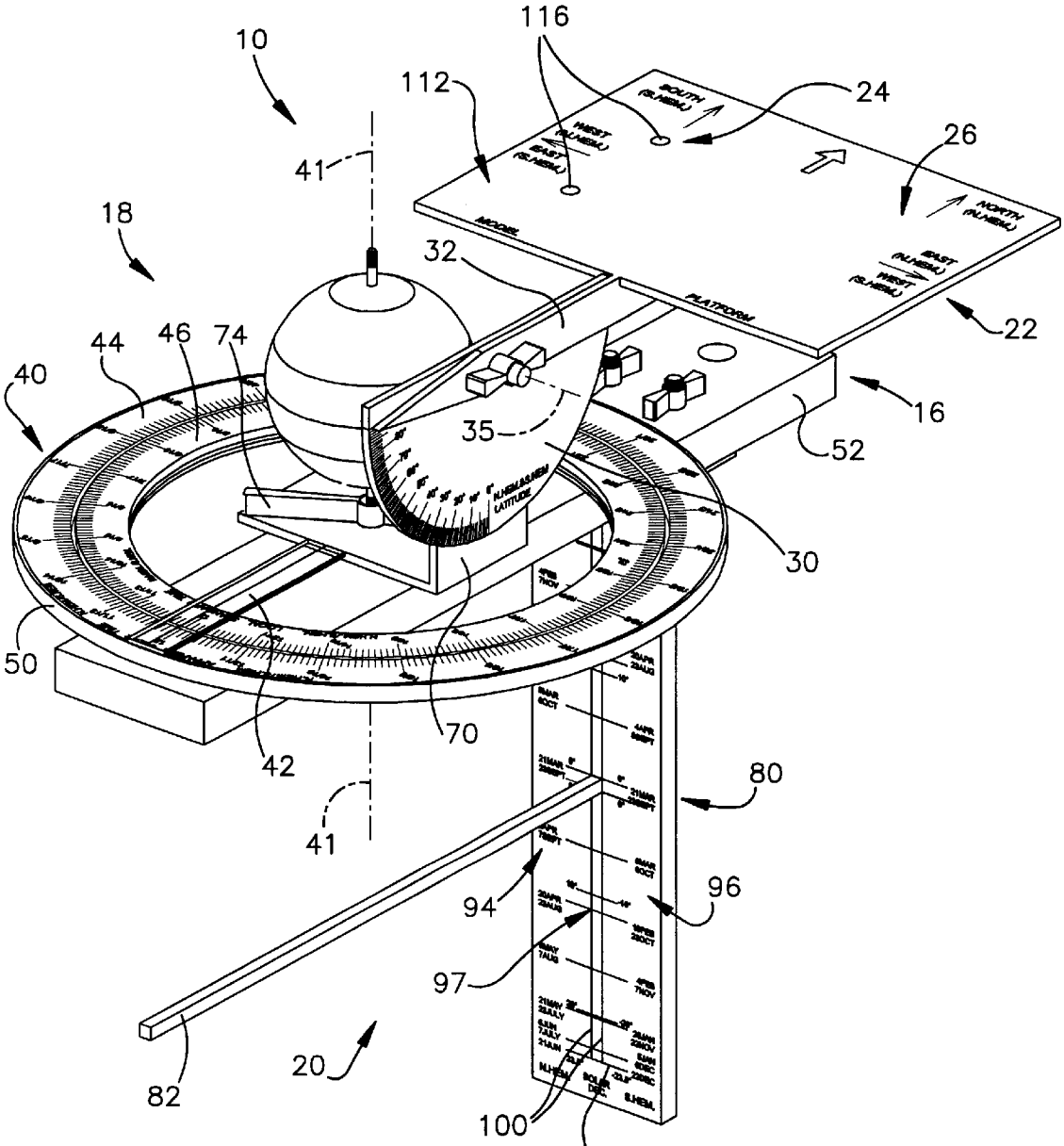
FIG. 2 is a close up axonometric view of the present invention.

The first orientation device 16 further includes a latitude scale 30 and a latitude pointer 32 as shown in FIGS. 1 and 2. The latitude pointer 32 is rotatable about a first axis 35 relative to the latitude scale 30. One end of the latitude pointer 32 is secured to the platform 22. The opposite end moves in an arc along the latitude scale 30. Rotation of the latitude pointer 32 about the first axis 35 produces a corresponding change in the position of the platform 22 relative to the latitude scale 30. Therefore, movement of the latitude pointer 32 to a specified latitude setting on the latitude scale 30 results in movement of the model 12 to a position corresponding to the specified latitude.

Figure 4:
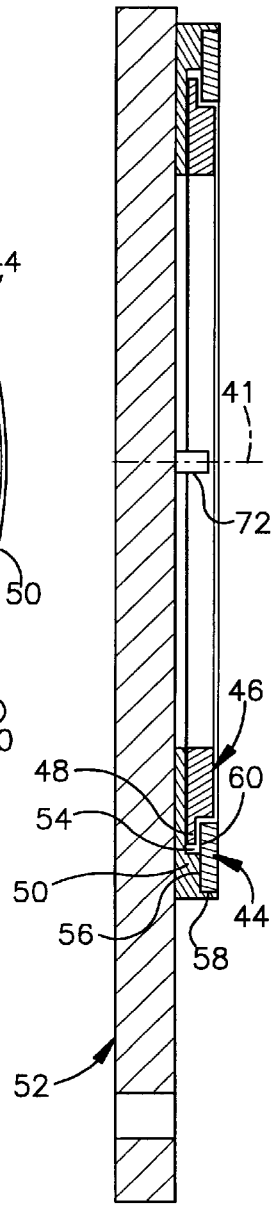
FIG. 4 is a side view of the equatorial-plane-time-ring piece.

As shown in FIGS. 1 and 2, the second orientation device 18 includes a circular time scale 40 centered on a second axis 41, and further includes a time pointer 42. The time scale 40 includes a non-rotatable outer time ring 44 with a peripheral time scale representing Apparent Solar Time (shown schematically), and further includes a rotatable inner time ring 46 with a peripheral time scale representing Local Standard Time (shown schematically). As shown in FIG. 4, the inner time ring 46 is configured such that the bottom outside edge forms a lip 48 extending around the circumference.

Figure 3:
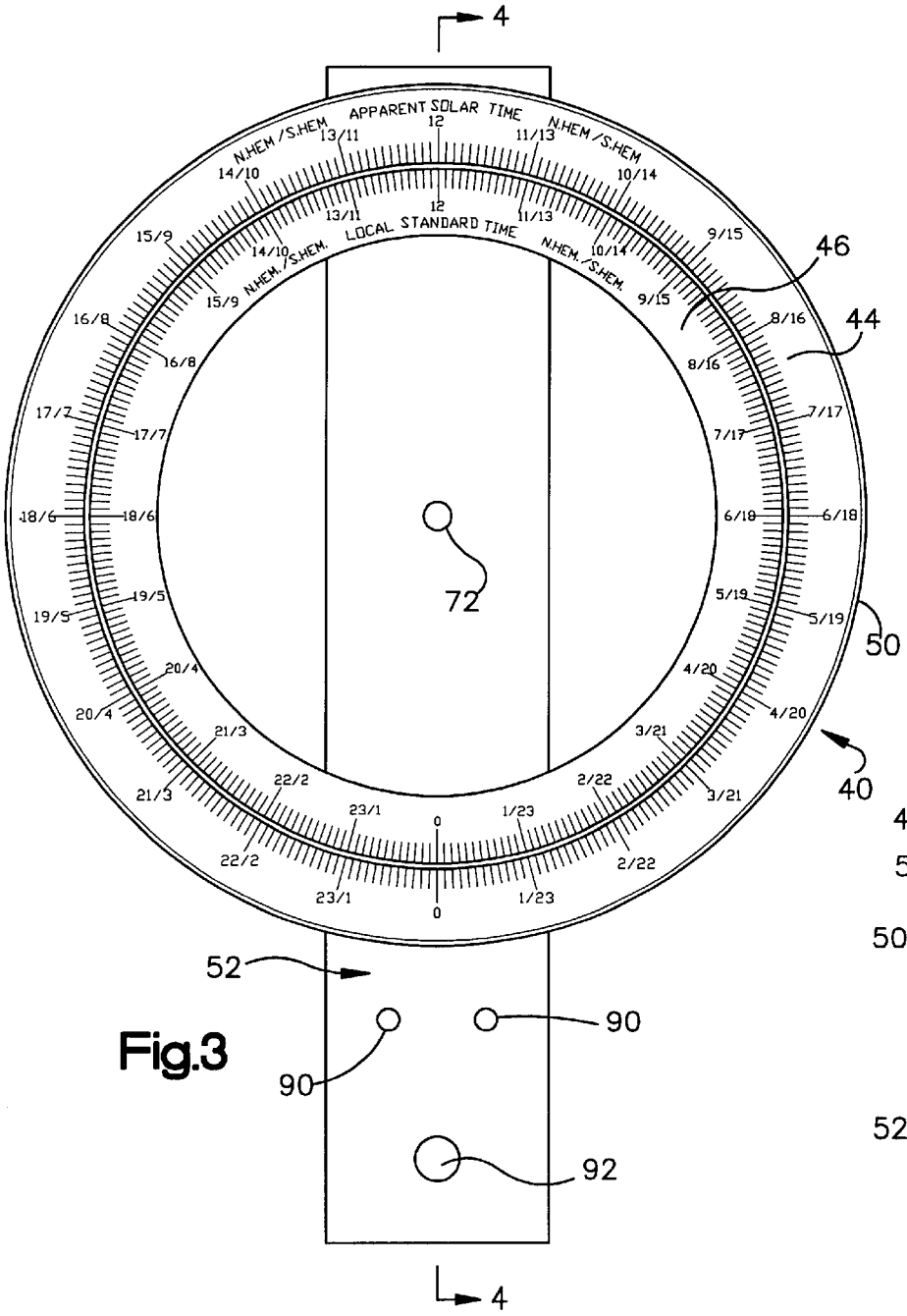
FIG. 3 is a top view of the equatorial-plane-time-ring piece.

The second orientation device 18 further includes a ring-shaped bracket 50 that is mounted on top of a supporting beam element 52, as best shown in FIG. 3. The supporting beam element 52 may be referred to as the "simulated equatorial-plane plate." The ring-shaped bracket 50 has a lower recess 54 to receive the inner time ring 46 and an upper recess 56 to receive the outer time ring 44 (see FIG. 4). A raised edge 58 forms the outer portion of the upper recess 56 of the ring shape bracket 50. The inner time ring 46 is mounted in the lower recess 54 of the ring-shaped bracket 50. The outer time ring 44 is set into the upper recess 56 and is permanently affixed using an adhesive or any other suitable fastening structure. The width of the outer time ring 44 is such that the inside edge 60 overhangs the lip 48 of the inner time ring 46. In this configuration, the inner time ring 46 can not be removed from the time scale 40, but is free to rotate about the second axis 41. The equatorial-plane plate 52, the time scale 40, and the ring-shaped bracket 50 may be referred to collectively as the "equatorial-plane-time-ring piece" (EPTR piece).

If the model 12 is viewed using conditions simulating sunlight striking the model 12 in the Southern Hemisphere, i.e., if the model 12 is positioned in accordance with the True North South reference points marked on the left side 24 of the platform 22, then the time rings 44 and 46 should have time scales calibrated for time in the Southern Hemisphere. However, if the model 12 is viewed using conditions simulating sunlight striking the model in the Northern Hemisphere, i.e., if the model 12 is positioned in accordance with the True North-South reference points marked on the right side 26 of the platform 22, then the time rings 44 and 46 should have time scales calibrated for time in the Northern Hemisphere.

As shown in FIGS. 1 and 2, the time pointer 42 is attached to a bracket 70, which may be referred to as the "latitude-scale time-pointer connector" (LSTP connector). The bracket 70 is rotatable about the second axis 41 relative to the time scale 40. An aperture in the bottom of the bracket 70 receives a threaded stud 72 (see FIG. 4) which projects from the supporting beam element 52. A lever nut 74 secures the bracket 70 to the supporting beam element 52. The bracket 70 is permanently affixed to the back of the latitude scale 30 of the first orientation device 16 such that rotation of the time pointer 42 about the time scale 40 results in a corresponding rotation of the attached bracket 70 and the latitude scale 30. Thus, rotation of the second orientation device 18 to a specified time of the day maintains the latitude setting for the model 12 by repositioning the first orientation device 16 without changing the relative positions of the internal elements of the first orientation device 16 relative to each other. The interconnected time pointer 42, the bracket 70, and the latitude scale 30 are together referred to as the "earth-axis-latitude piece" (EALP). When the EALP is attached to the platform 22, the EALP and the platform 22 are together referred to as the "EALP-IM Platform."

Figure 5B:
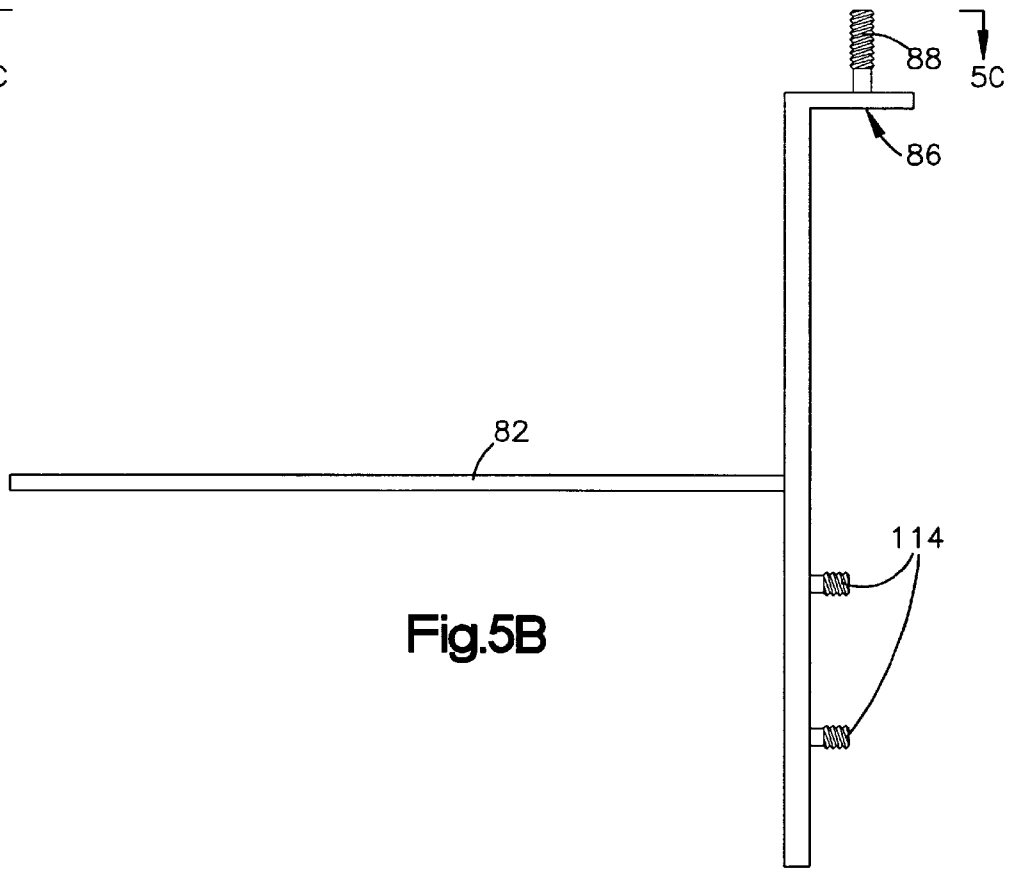
FIG. 5B is a side view of the day of the year scale.
Figure 5C:
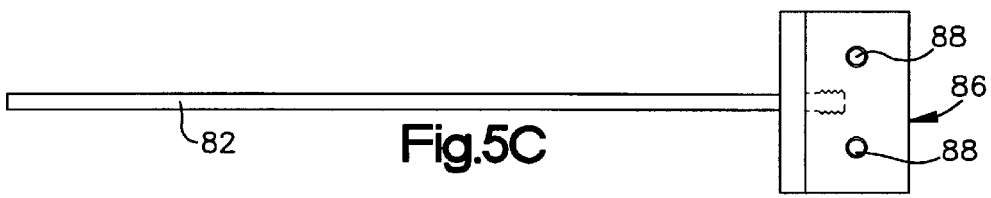
FIG. 5C is a top view of the day of the year scale.
Figure 5A:
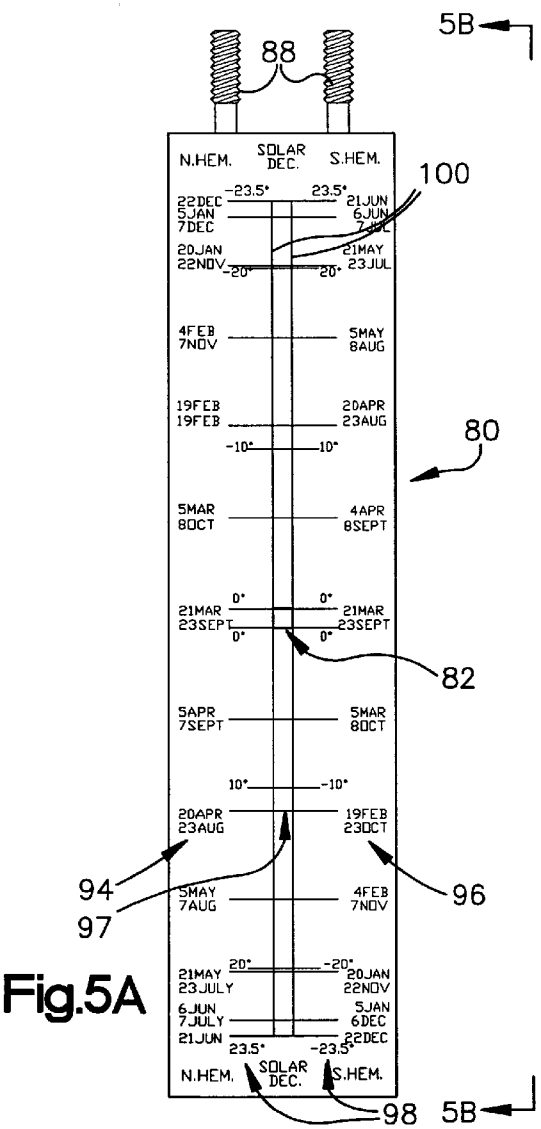
FIG. 5A is a front view of the day of the year scale.

The third orientation device 20 includes a day of the year scale 80, a gnomon 82, and a universal joint 84. As further shown in FIG. 1, the universal joint 84 is mounted on a standard photographic tripod 86. The day scale 80 is a vertically elongated, L-shaped structure with a bracket 86 at its upper end. As best shown in FIGS. 5A, B and C, two threaded studs 88 project from the upper end of the bracket 86. The two threaded studs 88 fasten the day scale 80 to the undersurface of the supporting beam element 52. The two threaded studs 88 pass through two corresponding stud mounting apertures 90 (see FIG. 3) in the beam element 52 and are fastened with a nut or any other suitable locking structure. The beam element 52 has a universal joint mounting aperture 92 positioned directly behind the stud mounting apertures 90 through which the universal joint 84 is mounted.

Figure 6:
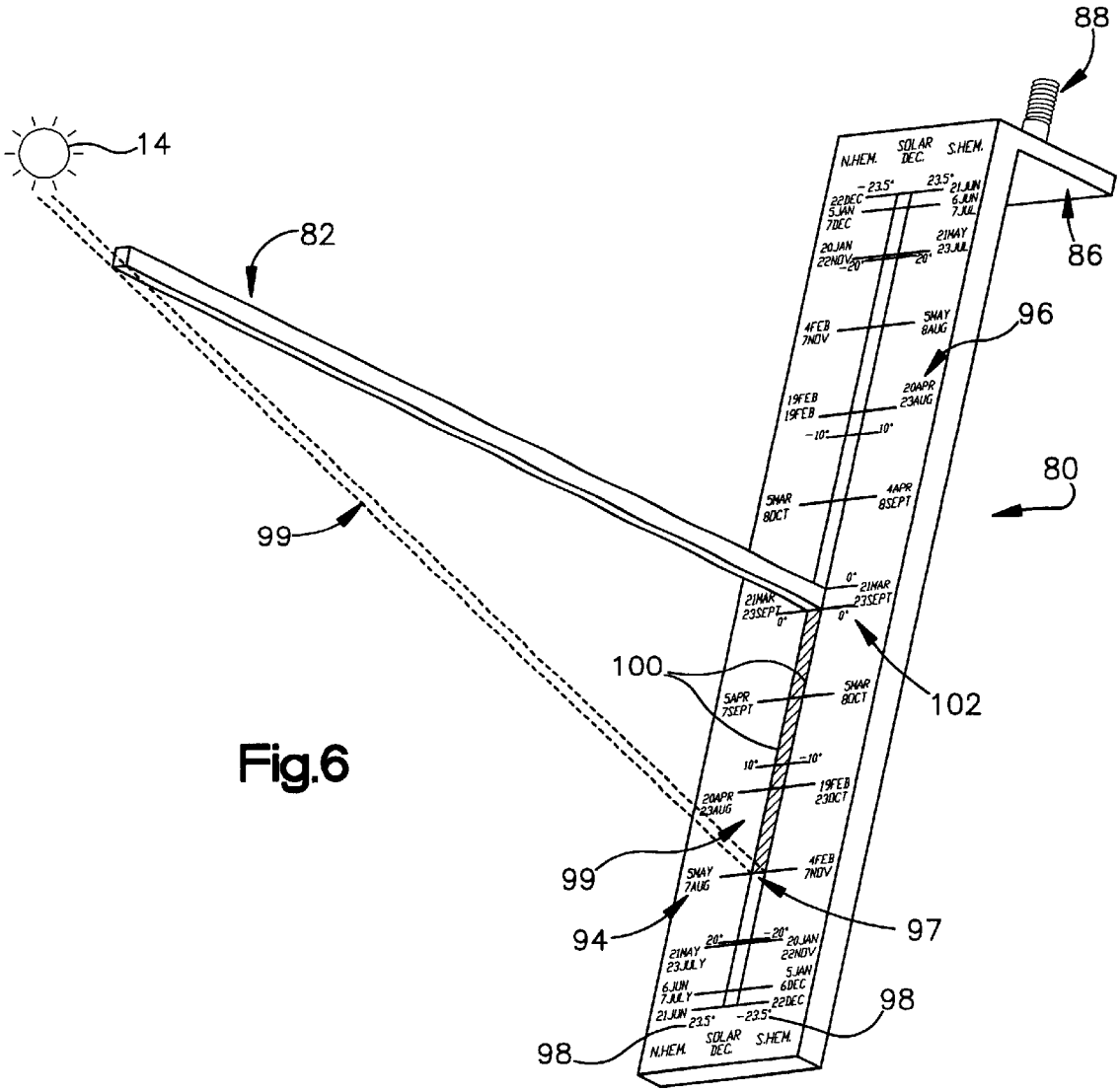
FIG. 6 is an axonometric view of the day of the year scale.

As best shown in FIG. 6, the day scale 80 includes a scale representing days of the year in the Northern Hemisphere 94, a scale representing days of the year in the Southern Hemisphere 96, and a scale for solar declination angle 98. A gnomon 82 is attached at a 90° angle to the day scale 80. To set the model 12 in the correct position relative to the sun for a given day of the year for the Northern Hemisphere, the third orientation device 20 is pointed at the sun 14 and then pivoted about the universal joint 84 such that a shadow 99 cast by the gnomon 82 onto the day scale 80 will extend between the gnomon shadow boundary lines 100 on the day scale 80, and from the 0° solar declination angle 102 to the line corresponding with the desired day of the year 97 (e.g. May 5) on the day scale 80, as best shown in FIG. 6.

As described above, the first, second and third orientation devices 16, 18 and 20 are mounted on a supporting beam element 52. Therefore, when the third orientation device 20 is moved into a position corresponding to a specific day of the year, the first and second orientation devices 16 and 18 are correspondingly moved by the supporting beam element 52 without the repositioning of any internal elements. Thus, moving the third orientation device 20 into a position which corresponds to a specific day of the year on the day scale 80 produces a corresponding change in the position of the platform 22 relative to the source of light 14 without changing the position of the time pointer 42 relative to the time scale 40, or the position of the platform 22 relative to the latitude scale 30.

Figure 7:
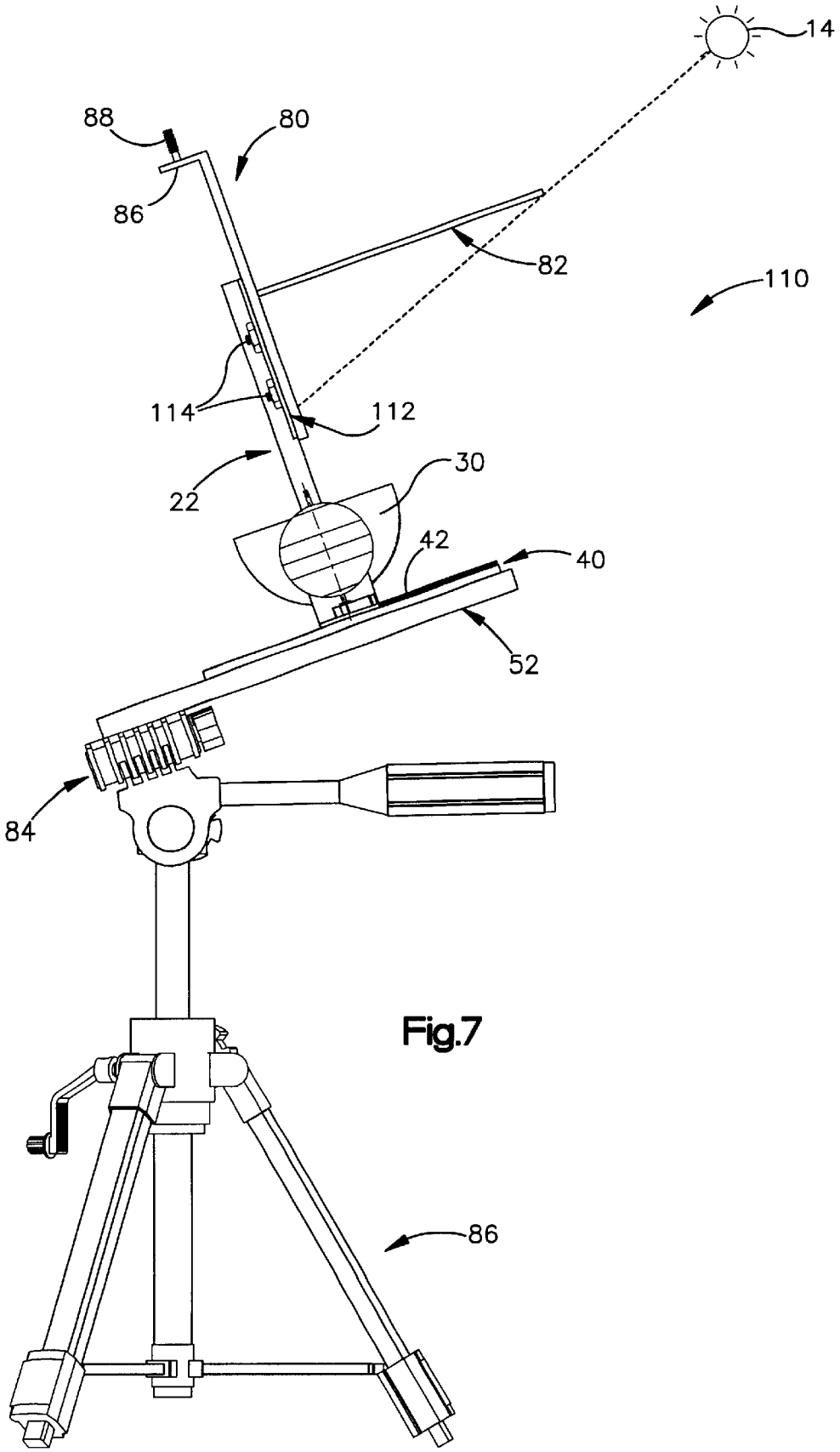
FIG. 7 is a back view of a preferred embodiment of the present invention.

In accordance with a major feature of the invention, the apparatus 10 is convertible to a universal sundial 110 via the rearrangement of several components of the apparatus 10 as shown in FIG. 7. Specifically, the platform 22 is raised to a vertical position by rotating the latitude pointer 32 to the 0° setting on the latitude scale 30. The day scale 80 with the attached gnomon 82 is removed from the third orientation device 20 and is attached to the top surface 112 of the platform 22 by inserting the two threaded mounting studs 114 on the back of the day scale 80 through two circular apertures in the platformn 22. A nut, or any other suitable locking structure, is used to secure the day scale 80 to the platform 22. When in the installed position for operation in the Northern Hemisphere, the day scale 80 is mounted to the platform 22 in the same orientation as when the apparatus 10 is operated as a heliodon. When in the installed position for operation in the Southern Hemisphere, the day scale 80 is mounted to the platform 22 in the opposite orientation as when the apparatus 10 is operated as a heliodon.

To determine the local standard time, the sundial 110 is operated in the following manner:

a. The local standard time is determined in a known manner.

b. The time difference is set between the apparent solar time and local standard time by adjusting the relative position of the respective time rings 44 and 46 in a known manner.

c. The time pointer 42 is turned to the correct local standard time at the actual moment of operation using Southern Hemisphere calibrated time scales 44 and 46 for operation of the sundial 110 in the Northern Hemisphere, or Northern Hemisphere calibrated time scales 44 and 46 for operation of the sundial 110 in the Southern Hemisphere.

d. The universal joint 84 on the tripod is adjusted such that sunlight will cast the gnomon shadow 99 onto the region of the day scale 80 bounded by the line marking the day of actual sundial operation, the gnomon shadow boundary lines 100, and the line marking the Equinox as described above for heliodon operation.

e. The universal joint 84 is locked on the tripod 86. The second axis 41 simulating the earth axis should now be practically parallel to the actual earth axis. [Note: Steps c, d and e need to be performed in a relatively short period of time, i.e., 20 to 30 seconds.]

f. As the sun moves, the bracket 70 is moved such that the gnomon shadow again falls onto the day scale 80 as described in step (d) above. The time is read as indicated by the time pointer 42 on the time rings 44 and 46 as described in step (c) above.

Figure 8:
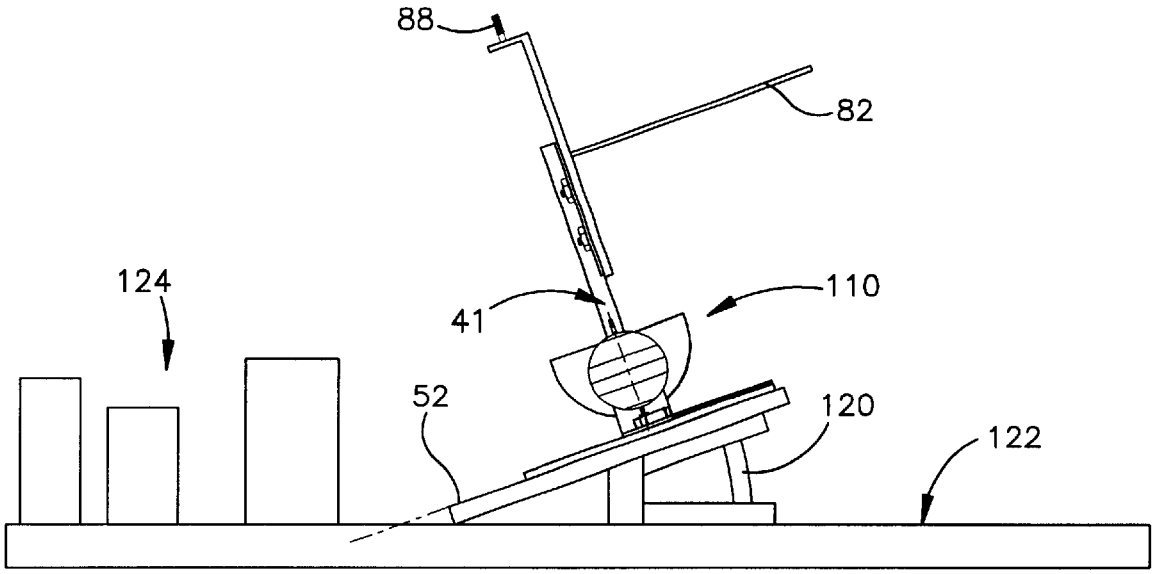
FIG. 8 is a left side view of a major feature of the present invention.
Figure 9:
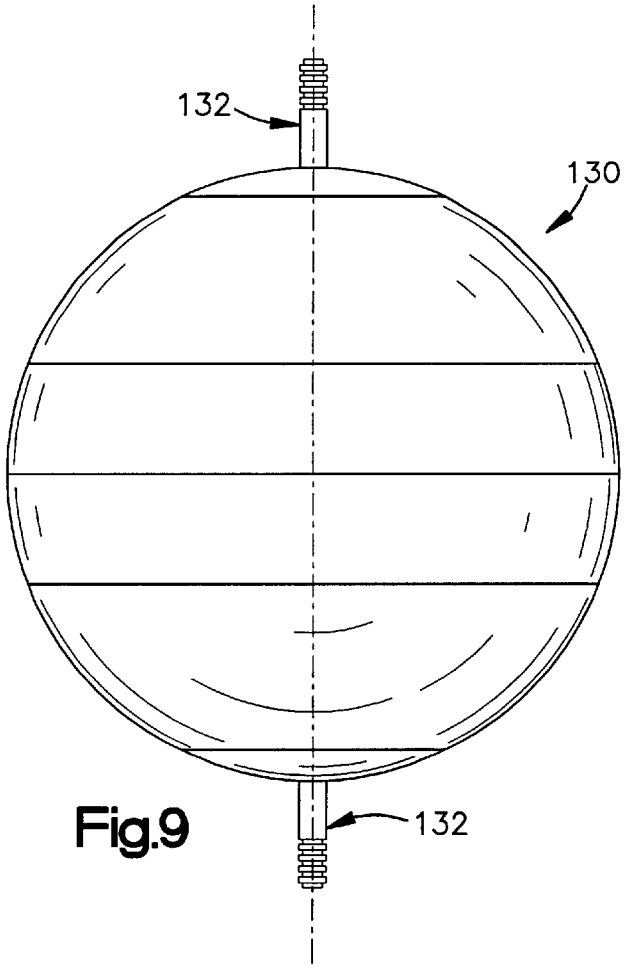
FIG. 9 is a view of a globe with threaded studs at the poles.

In accordance with another major feature of the invention, the apparatus 10 can be configured to be operative with models for testing with a light source, practically sunlight, which are too large for placement on the platform 22. As shown in FIG. 8, the apparatus 10 is first converted to the universal sundial 110 configuration as previously described. The sundial 110 is mounted on an adjustable sine block 120 which in turn is attached to a horizontal platform 122 supporting a large building model 124. The time pointer 42 of the sundial 110 is adjusted to the desired time. The sine block 120 is used to position the universal sundial 110 so that the second axis 41 simulating the earth axis should now be practically parallel to the earth axis reference to the horizontal platform 122 on which is placed the large building model 124 to be tested. The horizontal platform 122 is manually adjusted so that sunlight casts the gnomon shadow onto the day scale 80 for a specified day as previously described for sundial operation.

In accordance with another feature of the invention, a model globe of the earth 130 can be mounted on the threaded stud 72. The threaded stud 72 has a recess with internal threads at the upper end (not shown). The globe 130 has a threaded rod 132 affixed perpendicularly at each geographical pole which allows the globe 130 to be mounted on the threaded stud 72. The globe 130 is free to rotate about the second axis 41 relative to the time scale 40, as best shown in FIGS. 1 and 2. The globe 130 can also be inverted to reverse the positions of Northern and Southern Hemispheres. When the apparatus is operated in either the heliodon 10 or sundial 110 configuration, the globe 130 must be mounted with the South Pole pointed up for operation in the Southern Hemisphere, and mounted with the North Pole pointed up for operation in the Northern Hemisphere.

The invention has been described with reference to preferred embodiments. Those skilled in the art will perceive improvements, changes and modifications. Such improvements, changes and modifications are intended to be within the scope of the claims.

What is claimed is:

1. An apparatus for use with a source of light, said apparatus comprising:

a first orientation device including a latitude scale, a latitude pointer rotatable about a first axis relative to said latitude scale, and a platform configured to support an architectural model, said platform being mounted on said latitude pointer such that rotation of said pointer about said first axis produces a corresponding change in the position of said platform relative to said latitude scale;

a second orientation device including a time scale and a time pointer rotatable about a second axis relative to said time scale, said first orientation device being mounted on said time pointer such that rotation of said time pointer about said second axis produces a corresponding change in the position of said platform relative to said time scale without changing the position of said platform relative to said latitude scale; and a third orientation device including a day of the year scale, a gnomon operatively oriented relative to said day of the year scale, and a universal joint supporting said third orientation device for movement relative to a source of light;

said second orientation device being mounted on said third orientation device such that movement of said third orientation device on said universal joint produces a corresponding change in the position of said platform relative to the source of light without changing the position of said time pointer relative to said time scale or the position of said platform relative to said latitude scale.

2. An apparatus as defined in claim 1 further comprising a stand upon which said universal joint is mounted.

3. An apparatus as defined in claim 2 wherein said stand is a camera tripod.

4. An apparatus as defined in claim 1 wherein said platform is marked with True North-South reference points that indicate the position of the model with reference to the Northern and Southern Hemispheres.

5. An apparatus as defined in claim 1 wherein said time scale comprises a fixed outer time ring with a peripheral time scale representing Apparent Solar Time in the Northern Hemisphere, and a rotating inner time ring with a peripheral time scale representing Local Standard Time in the Northern Hemisphere.

6. An apparatus as defined in claim 1 wherein said time scale comprises a fixed outer time ring with a peripheral time scale representing Apparent Solar Time in the Southern Hemisphere, and a rotating inner time ring with a peripheral time scale representing Local Standard Time in the Southern Hemisphere.

7. An apparatus as defined in claim 1 wherein said day scale comprises a scale representing days of the year for the Northern Hemisphere, a scale representing days of the year for the Southern Hemisphere, and a scale representing solar declination angle.

8. An apparatus as defined in claim 1 further comprising a globe of the earth mounted on said time pointer for rotation of said globe about said second axis relative to said time scale.

9. An apparatus as defined in claim 8 wherein said globe can be mounted coaxially on said time pointer and can be inverted to reverse the position of the Northern and Southern Hemispheres.

10. An apparatus as defined in claim 1 wherein said orientation devices are configured such that said day of the year scale and said gnomon can be detached from said third orientation device and mounted on said first orientation device in the orientation of a sundial in cooperation with said time scale in said second orientation device.

11. An apparatus as defined in claim 10 further comprising an adjustable sine block to support said apparatus in the orientation of a sundial.

12. An apparatus comprising:

a supporting beam element; and a time scale attached to said supporting beam element, said time scale including an outer time ring fixed to said supporting beam element and an inner time ring rotatable relative to said supporting beam element, whereby said apparatus functions as an equatorial-plane-time-ring piece.

* * * * *